US006550761B1

(12) United States Patent
Chiang

(10) Patent No.: US 6,550,761 B1
(45) Date of Patent: Apr. 22, 2003

(54) INTEGRATED PAPER PRESSER AND STOPPER FOR AUTOMATIC PAPER FEEDER

(75) Inventor: Shu-Ya Chiang, Taichung (TW)

(73) Assignee: Umax Data Systems Inc., Hsinchu (TW)

( * ) Notice: Subject to any disclaimer, the term of this patent is extended or adjusted under 35 U.S.C. 154(b) by 0 days.

(21) Appl. No.: 09/985,692

(22) Filed: Nov. 6, 2001

(51) Int. Cl.[7] ..... B65H 3/52; B65H 3/34

(52) U.S. Cl. ..... 271/104; 271/121; 271/137; 271/167

(58) Field of Search ..... 271/104, 121, 271/137, 167

(56) References Cited

U.S. PATENT DOCUMENTS 5,044,622 A * 9/1991 Cattin ..... 271/121
5,350,168 A * 9/1994 Sheridan ..... 271/122
5,499,807 A * 3/1996 Nakamura et al. ..... 271/121
5,570,876 A * 11/1996 Samii ..... 271/119
5,573,338 A * 11/1996 Morikawa et al. ..... 400/611

* cited by examiner

*Primary Examiner*—Donald P. Walsh
*Assistant Examiner*—Kenneth W Bower
(74) *Attorney, Agent, or Firm*—Rosenberg, Klein & Lee

(57) ABSTRACT

An automatic paper feeder with an integrated paper presser and stopper is disclosed. The integrated paper presser and stopper includes a fixing section, a paper pressing section downward extended from the fixing section at an inclined angle toward a paper-out end of the paper tray, a first bent section formed at a lower end of the paper pressing section to define a first gap, a paper stopping section downward extended from the first bent section at an inclined angle toward the paper-out end of the paper tray, and a second bent section formed at a lower end of the paper stopping section to define a second gap which is smaller than the first gap.

6 Claims, 7 Drawing Sheets

INTEGRATED PAPER PRESSER AND STOPPER FOR AUTOMATIC PAPER FEEDER

BACKGROUND OF THE INVENTION

1. Field of the Invention

The present invention relates to an automatic paper feeder, and more particularly to an integrated paper presser and stopper for an automatic paper feeder.

2. Description of the Prior Art

An automatic paper feeder is frequently included in various kinds of office automation equipment, such as image-scanning device, photocopier, printer, etc., so that paper sheets to be scanned, copied or printed could be automatically separated and fed via the automatic paper feeder. FIG. 1 illustrates a scanner 1 and a conventional automatic paper feeder 2 associated therewith. The scanner 1 is internally provided with an optical scanning module 11, a pair of guide bars 12, and related optical components, such as focusing lens, image sensor, driving mechanism, etc. The optical scanning module 11 is moved along the guide bars 12 under control of a control circuit of the scanner 1, and a sheet of paper 3 to be scanned is fed with the automatic paper feeder 2 for image scanning.

FIG. 2 shows an internal structure of the automatic paper feeder 2 of FIG. 1. The automatic paper feeder 2 mainly includes a paper tray 21, a paper feeding roller 22, a paper pressing plate 23, a stopping plate 24, a paper separating mechanism 25, and a paper separating plate 26. Paper sheets 3 to be fed are stacked on the paper tray 21 and held in place under a pressure applied by the paper pressing plate 23 on the paper sheets 3. Meanwhile, lower ends of the stacked paper sheets 3 are positioned against the stopping plate 24. A main function of the paper separating mechanism 25 is to provide a proper gap between the stopping plate 24 and the paper feeding roller 22 and to apply a proper pressure against the paper separating plate 26.

When the paper feeding roller 22 rotates, it brings a lowermost sheet of paper 3 in the paper tray 21 to move in a direction indicated by arrow I toward the gap between the paper feeding roller 22 and the paper separating plate 26. In the event two or more sheets of paper 3 are fed toward the gap, a difference between the friction coefficients of the paper feeding roller 22 and the paper separating plate 26 would allow only the paper in contact with the paper feeding roller 22 to move through the gap. Therefore, the stacked paper sheets 3 could be separately fed for scanning one by one.

In the conventional automatic paper feeder 2 having the above-described structure, separated paper pressing plate 23 and stopping plate 24 are provided to compressively hold and stop, respectively, paper sheets 3 stacked on the paper tray 21. These two components are mounted in the automatic paper feeder 2 through their respective fixing mechanisms, and therefore complicate the structure of the automatic paper feeder 2.

Number of paper sheets 3 stacked on the paper tray 21 varies depending on actual needs. When there are more sheets of paper 3 stacked on the paper tray 21 for subsequent process, more units of stopping plate 24 might be required to stop the stacked paper sheets 3 at different stages. However, the automatic paper feeder would become more complicate in its structure and assembling when several stopping plates 24 are to be included in its very limited internal space.

Therefore, it is desirable to develop a paper pressing and stopping structure that does not complicate the whole structure of the automatic paper feeder and the assembling thereof.

SUMMARY OF THE INVENTION

A primary object of the present invention is to provide an integrated paper presser and stopper for an automatic paper feeder, so that a reduced space is needed in the automatic paper feeder to effectuate the functions of pressing and stopping paper sheets stacked on the paper tray.

Another object of the present invention is to provide an integrated paper presser and stopper for automatic paper feeder that may include increased number of paper stopping sections to achieve enhanced paper stopping effect when there are a large amount of paper sheets stacked on the paper tray. The provision of multiple paper stopping sections on a one-piece paper presser and stopper also reduces difficulties in subsequent separation of paper sheets.

To achieve the above and other objects, the structure according to the present invention mainly includes a fixing section, a paper pressing section downward extended from the fixing section at an inclined angle toward a paper-out end of the paper tray, a first bent section formed at a lower end of the paper pressing section to define a first gap, a paper stopping section downward extended from the first bent section at an inclined angle toward the pauper-out end of the paper tray, and a second bent section formed at a lower end of the paper stopping section to define a second gap which is smaller than the first gap. Preferably, a torsional elastic element is further associated with the fixing section to provide the integrated paper presser and stopper with a compression stress.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
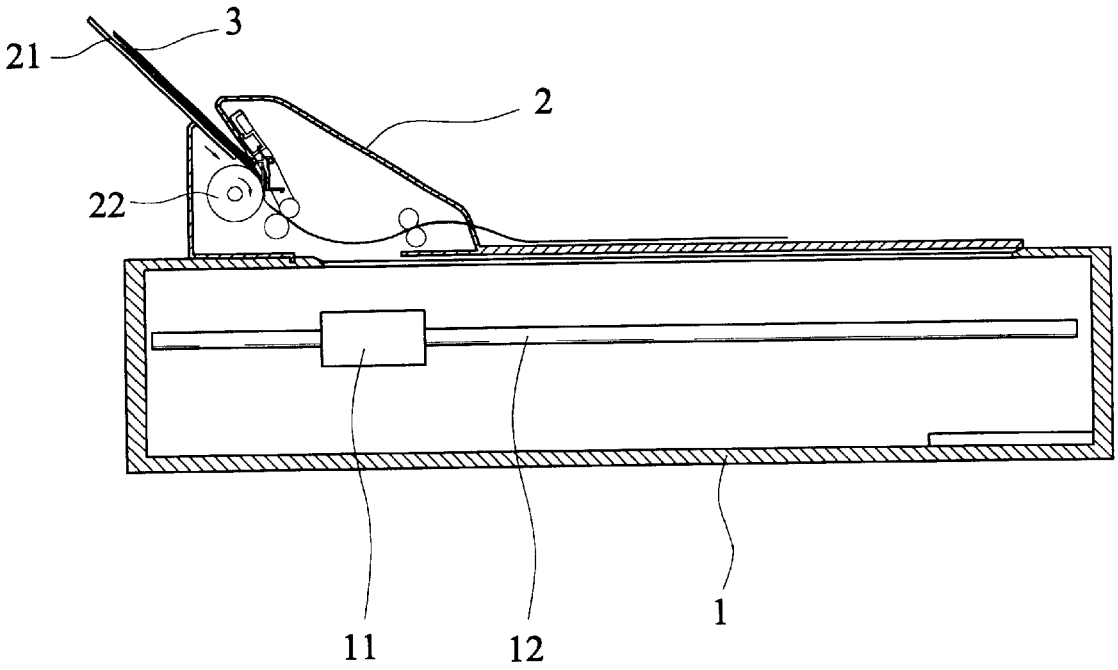
FIG.1(Prior Art)
FIG. 1 is a sectional view showing a conventional automatic paper feeder associated with a scanner.
Figure 2:
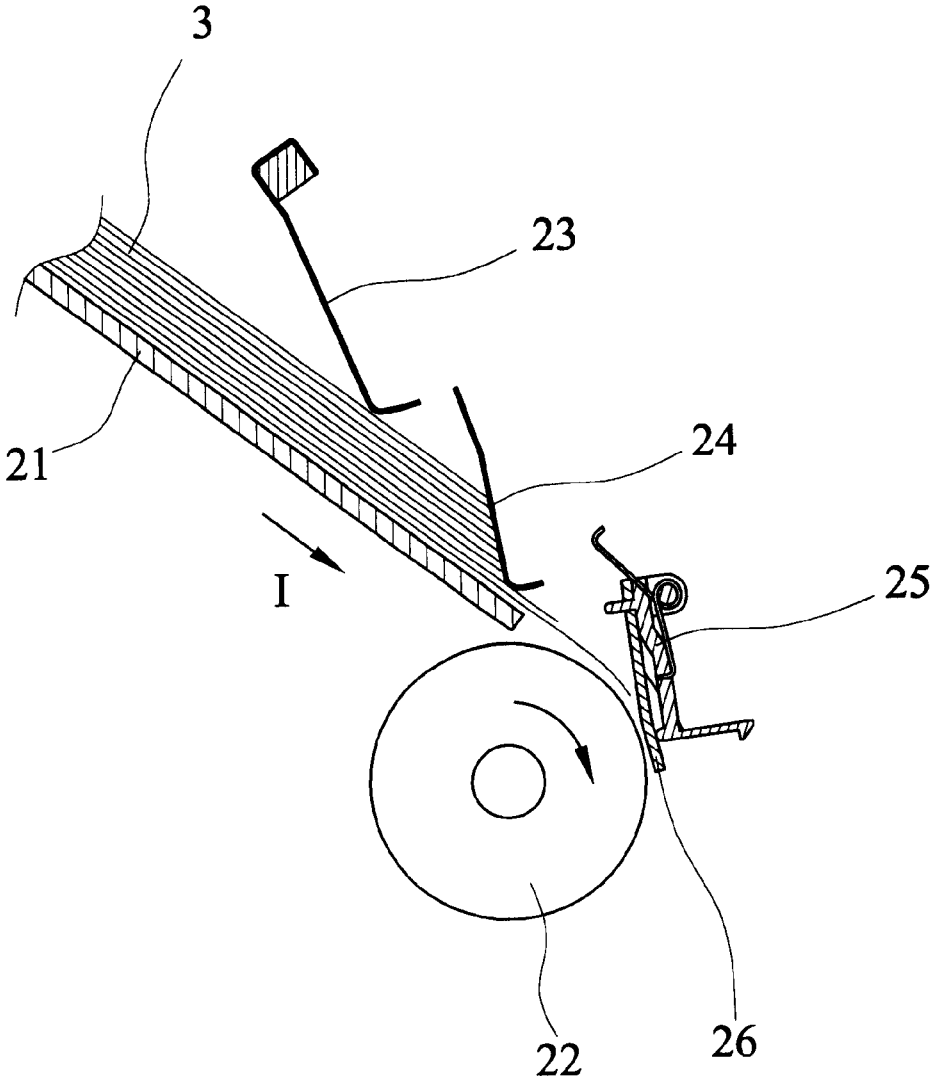
FIG.2(Prior Art)
FIG. 2 is a fragmentary sectional view of the conventional automatic paper feeder of FIG. 1 showing arrangement of different parts thereof.
Figure 3:
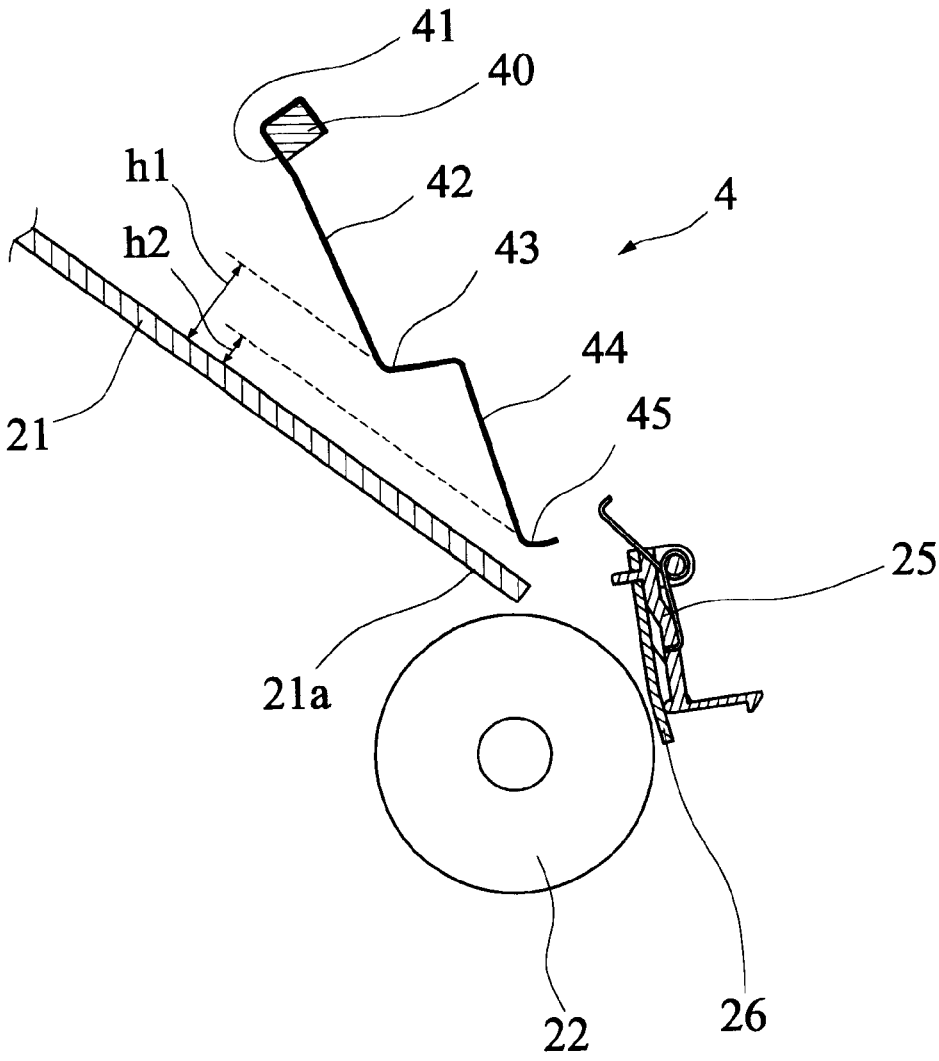
FIG. 3 is a sectioned side view of an automatic paper feeder having an integrated paper presser and stopper according to a first embodiment of the present invention.

Please refer to FIG. 3 that is a sectioned side view of an automatic paper feeder having an integrated paper presser and stopper 4 according to a first embodiment of the present invention. In this and other following drawings, members similar to those in FIGS. 1 and 2 will be denoted with the same reference numbers. As shown, the integrated paper presser and stopper 4 of the first embodiment of the present invention is a part of an automatic paper feeder having a paper tray 21, on which paper sheets to be fed are stacked. A lower end of the paper tray 21 is defined as a paper-out end 21*a*.

The automatic paper feeder also includes a paper feeding roller 22 located in the vicinity of the paper-out end 21*a* of the paper tray 21, and a paper-paper separating mechanism 25 and a paper separating plate 26 located download the paper-out end 21*a* of the paper tray 21 opposite to the paper feeding roller 22.

The integrated paper presser and stopper 4 includes an upper end serving as a fixing section 41, at where the whole integrated paper presser and stopper 4 is fixed to a mounting point 40 inside the automatic paper feeder to locate above the paper tray 21.

The integrated paper presser and stopper 4 downward extends from the fixing section 41 toward the paper-out end 21*a* at a predetermined inclined angle and by a predetermined length to define a paper pressing section 42. The integrated paper presser and stopper 4 is smoothly bent upward at a lower end of the paper pressing section 42 to form a first bent section 43, such that there is a first gap hi defined between the first bent section 43 and the paper tray 21.

The integrated paper presser and stopper 4 upward extends from the first bent section 43 by a predetermined small length and then turns downward to extend a predetermined length toward the paper-out end 21*a* of the paper tray 21, so as to define a paper stopping section 44. The integrated paper presser and stopper 4 is again bent upward at a lower end of the paper stopping section 44 to define a second bent section 45 with a free end thereof smoothly extending upward by a small distance, so that there is a second gap h2 defined between the second bent section 45 and the paper tray 21. The second gap h2 is smaller than the first gap h1 and is within the range from about 0.3 mm to about 0.5 mm. That is, the whole integrated paper presser and stopper 4 consists of integrally connected fixing section 41, paper pressing section 42, first bent section 43, paper stopping section 44, and second bent section 45, so that the second bent section 45 is closely adjacent to the paper-out end 21*a* of the paper tray 21.

Figure 4:
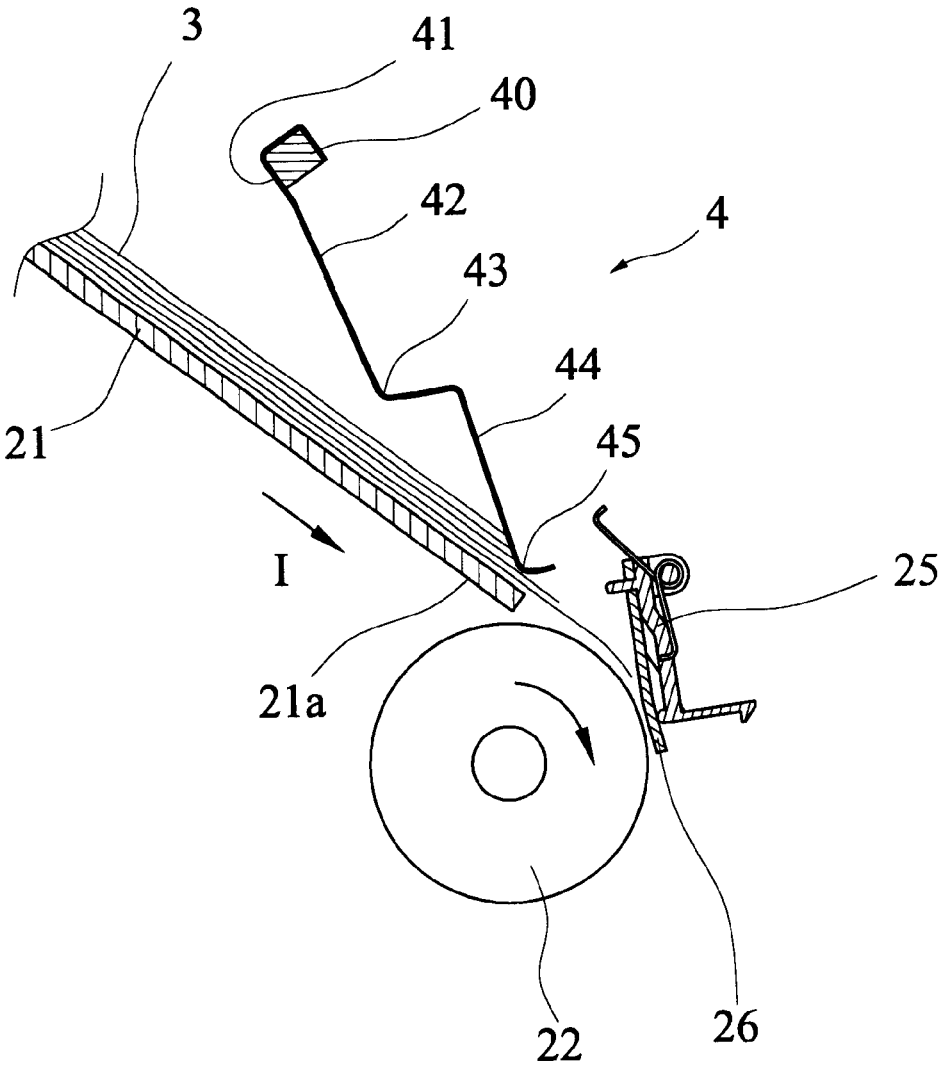
FIG. 4 shows a small amount of paper is stacked on a paper tray of the automatic paper feeder of FIG. 3.
Figure 5:
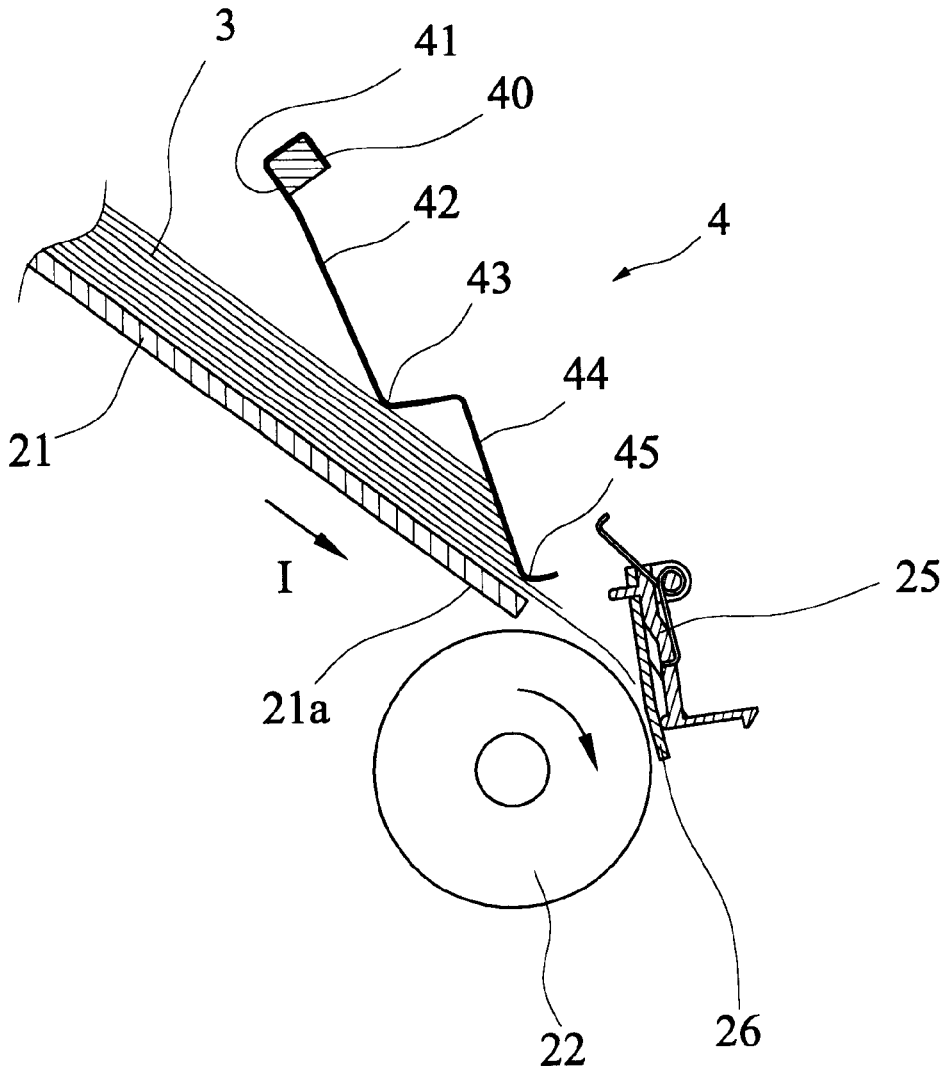
FIG. 5 shows a large amount of paper is stacked on the paper tray of the automatic paper feeder of FIG. 3.

Sheets of paper 3 to be fed are stacked on the paper tray 21. When an overall thickness of the paper stacked on the paper tray 21 is larger than the second gap h2 but smaller than the first gap hi, as shown in FIG. 4, paper sheets 3 beyond the second gap h2 are stopped at lower ends by the paper stopping section 44. Only paper sheets 3 that are stacked within the second gap h2 could pass an opening between the second bent section 45 and the paper tray 21.

When the paper sheets 3 within the second gap h2 are fed toward the paper feeding roller 22, they are brought by the paper feeding roller 22 to move further one by one. Wherein, a lowermost one of the paper sheets 3 is first fed through the paper feeding roller 22. In the event two or more sheets 3 are simultaneously fed to the paper feeding roller 22, a difference between the friction coefficients of the paper feeding roller 22 and the paper separation plate 26 will allow only the one sheet 3 that is in contact with the paper feeding roller 22 to move through a gap between the paper feeding roller 22 and the paper separating plate 26. Thus, the stacked paper sheets 3 could be accurately separated one by one.

Figure 6:
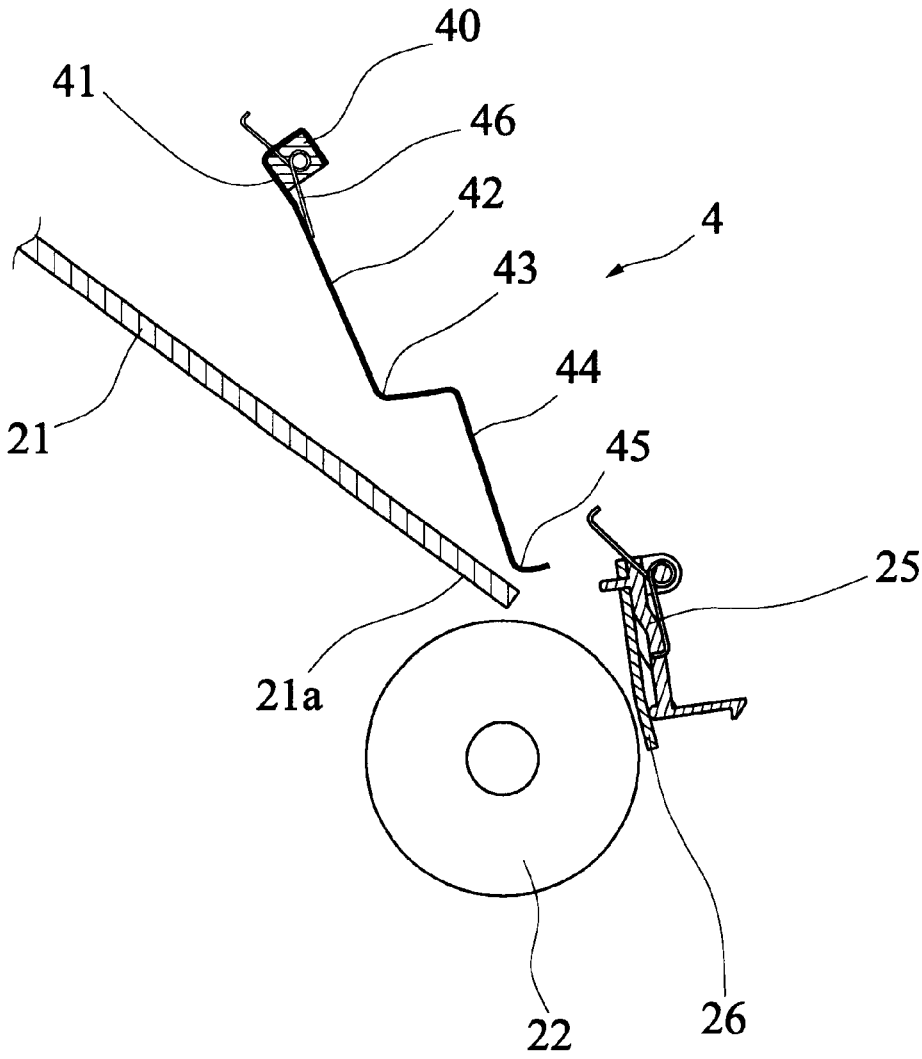
FIG. 6 is a sectioned side view of an automatic paper feeder having an integrated paper presser and stopper according to a second embodiment of the present invention.

FIG. 6 is a sectioned side view showing an automatic paper feeder having an integrated paper presser and stopper 4 according to a second embodiment of the present invention. This second embodiment is generally structurally similar to the first embodiment, except that it includes a torsional elastic element 46 provided at the fixing section 41 to provide the integrated paper presser and stopper with an even stronger compression stress.

Figure 7:
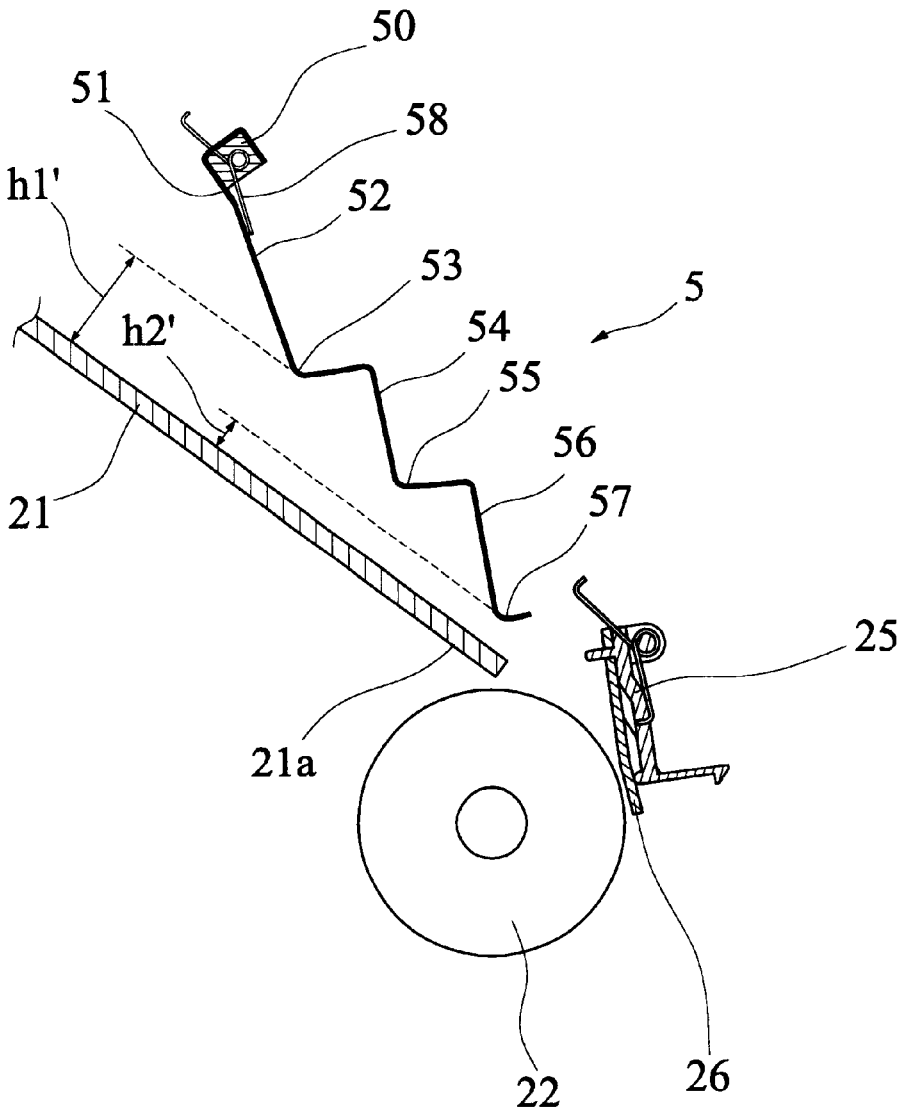
FIG. 7 is a sectioned side view of an automatic paper feeder having an integrated paper presser and stopper according to a third embodiment of the present invention.

FIG. 7 is a sectioned side view showing an automatic paper feeder having an integrated paper presser and stopper 5 according to a third embodiment of the present invention. This embodiment is generally functionally similar to the first and the second embodiment, except that it includes multiple paper stopping sections. The integrated paper presser and stopper 5 shown in FIG. 7 includes a mounting point 50, a fixing section 51, a paper pressing section. 52, a first bent section 53, a first paper stopping section 54, a second bent section 55, a second paper stopping section 56, and a third bent section 57. A first gap h1' is defined between the first bent section 53 and the paper tray 21.

In this embodiment, a number of paper stopping sections connected by bent sections are provided, forming an integrated paper stopping assembly. The first end of the integrated paper stopping assembly is connected to the free end of the first bent section 53 and the second end thereof is extended close to the paper-out end 21*a* of the paper tray 21, such that a second gap h2' is defined between the third bent section 57 and the paper tray 21. The second gap h2' is smaller than the first gap h1' and is within the range from about 0.3 mm to about 0.5 mm.

By providing multiple paper stopping sections, the integrated paper presser and stopper of the present invention may be extended to meet actual need in its application, so that a better paper stopping effect could be achieved while difficulties in the subsequent separating of stacked paper sheets could be reduced.

Preferably, a torsional elastic element 58 is provided at the fixing section 51 to provide the integrated paper presser and stopper with an even stronger compression stress.

It is apparent that although the present invention is illustrated with the description of a preferred embodiments of the system in accordance with the present invention, it is contemplated that there may be changes and modifications in the described embodiment and examples that can be carried out without departing from the scope of the invention which is intended to be limited only by the appended claims.

What is claimed is:

1. An integrated paper presser and stopper for an automatic paper feeder, the automatic paper feeder comprising a paper tray for holding paper sheets to be fed, a paper feeding roller located near to a paper-out end of the paper tray, and a paper separating plate closely located at the paper-out end of the paper tray and opposite to the paper feeding roller, the integrated paper presser and stopper comprising:

a fixing section at where the integrated paper presser and stopper is mounted to a position above the paper tray of the automatic paper feeder;

a paper pressing section downward extended from a lower end of the fixing section toward the paper-out end of the paper tray at an inclined angle;

a first bent section formed at a lower end of the paper pressing section by upward turning the integrated paper presser and stopper at a predetermined angle and by a predetermined length forming a free end, such that a first gap is defined between the first bent section and the paper tray;

a paper stopping section formed at the free end of the first bent section by turning the integrated paper presser and stopper downward at a predetermined inclined angle to extend a predetermined length toward the paper-out end of the paper tray; and a second bent section formed at a lower end of the paper stopping section by upward turning the integrated paper presser and stopper at a predetermined angle and by a predetermined length, such that a second gap is defined between the second bent section and the paper tray, and the second gap being smaller than the first gap.

2. The integrated paper presser and stopper as claimed in claim 1, wherein the second gap between the paper stopping section and the paper tray is within a range from about 0.3 mm to about 0.5 mm.

3. The integrated paper presser and stopper as claimed in claim 1, further comprising a torsional elastic element associated with the fixing section to provide the integrated paper presser and stopper with a compression stress.

4. An integrated paper presser and stopper for an automatic paper feeder, the automatic paper feeder comprising a paper tray for holding paper sheets to be fed, a paper feeding roller located near to a paper-out end of the paper tray, and a paper separating plate closely located at the paper out end of the paper tray and opposite to the paper feeding roller, the integrated paper presser and stopper comprising:

a fixing section at where the integrated paper presser and stopper is mounted to a position above the paper tray of the automatic paper feeder;

a paper pressing section downward extended from a lower end of the fixing section toward the paper-out end of the paper tray at an inclined angle;

a bent section formed at a lower end of the paper pressing section by upward turning the integrated paper presser and stopper at a predetermined angle and by a predetermined length forming a free end, such that a first gap is defined between the bent section and the paper tray; and a plurality of paper stopping sections connected by a plurality of bent sections therebetween, forming an integrated paper stopping assembly having a first end connected to the free end of the bent section and a second end extended close to the paper-out end of the paper tray, such that a second gap is defined between the second end of the integrated paper stopping assembly and the paper tray, and the second gap being smaller than the first gap.

5. The integrated paper presser and stopper as claimed in claim 4, wherein the second gap between the second end of the integrated paper stopping assembly and the paper tray is within a range from about 0.3 mm to about 0.5 mm.

6. The integrated paper presser and stopper as claimed in claim 4, further comprising a torsional elastic element associated with the fixing section to provide the integrated paper presser and stopper with a compression stress.

* * * * *